US007904967B1

(12) United States Patent
Cummings

(10) Patent No.: US 7,904,967 B1
(45) Date of Patent: Mar. 15, 2011

(54) UNI BOXING GLOVE

(76) Inventor: Aurillo Cummings, South Ozone Park, NY (US)

( * ) Notice: Subject to any disclaimer, the term of this patent is extended or adjusted under 35 U.S.C. 154(b) by 63 days.

(21) Appl. No.: 12/012,918

(22) Filed: Feb. 6, 2008

Related U.S. Application Data

(63) Continuation-in-part of application No. 11/504,329, filed on Aug. 15, 2006, now abandoned.

(60) Provisional application No. 60/721,499, filed on Sep. 29, 2005.

(51) Int. Cl.
*A41D 13/08* (2006.01)

(52) U.S. Cl. ..... 2/18

(58) Field of Classification Search ..... 2/18, 161.1, 2/161.6
See application file for complete search history.

(56) References Cited

U.S. PATENT DOCUMENTS

| | | | |
|---|---|---|---|
| 421,447 | A | 2/1890 | Stewart |
| 3,491,373 | A | 1/1970 | Thomas, Jr. |
| 4,424,595 | A | 1/1984 | Albert |
| D273,343 | S | 4/1984 | Albert |
| 4,868,927 | A | 9/1989 | Bourdeau et al. |

*Primary Examiner* — Katherine Moran
(74) *Attorney, Agent, or Firm* — Emery L. Tracy

(57) ABSTRACT

A uni boxing glove for use in boxing practice and matches is provided. The uni glove covers the left and right hands, fingers, thumb, and a portion of both wrists of a user. The glove comprises a punching portion, protrusion formed in the punching portion, and hand receiving portions.

18 Claims, 3 Drawing Sheets

UNI BOXING GLOVE

The present application is a continuation-in-part of U.S. patent application Ser. No. 11/504,329, filed Aug. 15, 2006, now abandoned entitled "Uni Boxing Glove", which claims benefit of priority of provisional patent application Ser. No. 60/721,499, filed on Sep. 29, 2005, entitled "Uni Boxing".

BACKGROUND OF THE INVENTION

1. Field of the Invention

This invention relates generally to a uni boxing glove and, more particularly, the invention relates to a uni boxing glove that combines regulation boxing gloves and joins them together at the fingertips.

2. Description of the Prior Art

Boxing is a major sport in the United States. Heavyweight boxing matches, in fact, are spectacles rivaling those of any other sport.

The sport of boxing in which boxers fight with their fists goes back in history at least as far back as the Olympic games in ancient Greece. In these games the boxers wound heavy straps of leather about their hands and wrists. It was not until the 19th century that boxers began to wear boxing gloves in the form of heavily-padded leather mittens.

The conventional boxing glove used in the past consists of a heavily padded leather mitten for confining the fingers of each hand and a separate thumb sheath, equally padded for the thumb, extending from the palm of the glove. The conventional boxing glove used in the past consists of a heavily padded leather mitten for confining the fingers of the hand and a separate thumb sheath, equally padded for the thumb. The boxer, during a match, clenches his fingers in the form of a fist in the glove to the center of the palm and closes the thumb sheath over the index finger. In this position, the thumb guard, which forms a rise in the glove nearest the knuckle of the index finger, the thumb sheath, and the glove body combine to form a continuous, rounded fist.

Too often deaths occur to boxers because of the devastating head trauma received in a boxing match or during practice. A glove that would lessen the trauma without diminishing the excitement and skill of the sport, would certainly be a welcome addition to the art.

SUMMARY

The present invention is a uni boxing glove for use in boxing practice and matches. The uni boxing glove covers the left and right hands, fingers, thumb, and a portion of both wrists of a user. The uni boxing glove comprises a punching portion formed from a padded material and confining the fingers of each hand with the punching end having padding on at least a front end for forward stabs, on an underside for covering, and on the sides for side to side striking. A protrusion is formed in the punching portion for receiving the thumbs only of each hand with the protrusion formed in the padded material opposite the underside and the protrusion protruding above the remaining portions of the punching portion prior to insertion of the hands into punching portion. A first wrist receiving portion is secured to the punching portion for receiving the wrist of the left hand. A second wrist receiving portion secured to the punching portion for receiving the wrist of the right hand. A left hand opening is formed in the first wrist receiving portion for receiving the left hand of the user. A right hand opening is formed in the second wrist receiving portion for receiving the right hand of the user with the right hand opening separate from and connected adjacent to the left hand opening. A first elastic band completely encircles the first wrist receiving portion and extends from the left hand opening to the punching portion. A second elastic band completely encircles the second wrist receiving portion and extends from the right hand opening to the punching portion. A first slit is formed in the first wrist receiving portion with the first slit extending from the left hand opening to the punching portion and a second slit formed in the second wrist receiving portion with the second slit extending from the right hand opening to the punching portion. A first tightening mechanism extends along the first slit from left hand opening to the punching portion for evenly tightening the first wrist portion about the wrist and evenly loosening the left hand opening about the wrist. A second tightening mechanism extends along the second slit from the right hand opening to the punching portion for evenly tightening the second wrist portion about the wrist and evenly loosening the second wrist portion about the wrist.

In addition, the present invention includes a method for boxing with a glove with the glove covering the left and right hands, fingers, thumb, and a portion of both wrists of a user. The method comprises forming a punching portion from a padded material, forming a protrusion in the punching portion, protruding the protrusion above the remaining portions of the punching portion prior to insertion of the hands into punching portion, securing a first wrist receiving portion to the punching portion, securing a second wrist receiving secured to the punching portion, forming a left hand opening in the first wrist receiving portion, forming a right hand opening in the second wrist receiving opening, completely encircling the first wrist receiving portion with a first elastic band, extending the first elastic band from the left hand opening to the punching portion, completely encircling the second wrist receiving portion with a second elastic band, extending the second elastic band from the right hand opening to the punching portion, forming a first slit in the first wrist receiving portion, extending the first slit from the left hand opening to the punching portion, forming a second slit in the second wrist receiving portion, extending the second slit from the right hand opening to the punching portion, inserting the left hand into the left hand opening, inserting the right hand in the right hand opening, tightening the left hand opening and the right hand opening about the wrist, and clasping the hands together.

The present invention further includes a uni boxing glove for use in boxing practice and matches with the uni boxing glove covering the left and right hands, fingers, thumb, and a portion of both wrists of a user. The uni boxing glove comprises a punching portion formed from a padded material and confining the fingers of each hand with the punching end having padding on at least a front end for forward stabs, on an underside for covering, and on the sides for side to side striking. A protrusion is formed in the punching portion for receiving the thumbs only of each hand with the protrusion formed in the padded material opposite the underside with the protrusion protruding above the remaining portions of the punching portion prior to insertion of the hands into punching portion. A first wrist receiving portion is secured to the punching portion for receiving the wrist of the left hand. A second wrist receiving portion is secured to the punching portion for receiving the wrist of the right hand. A left hand opening is formed in the first wrist receiving portion for receiving the left hand of the user. A right hand opening formed in the second wrist receiving portion for receiving the right hand of the user with the right hand opening separate from and connected adjacent to the left hand opening. First dual tightening means extend along the first slit from left hand opening to the punching portion for evenly tightening the first wrist portion about the wrist and evenly loosening the left hand opening about the wrist. Second dual tightening means extend along the second slit from the right hand opening to the punching portion for evenly tightening the second wrist portion about the wrist and evenly loosening the second wrist portion about the wrist.

DETAILED DESCRIPTION OF THE PREFERRED EMBODIMENTS

Figure 1:
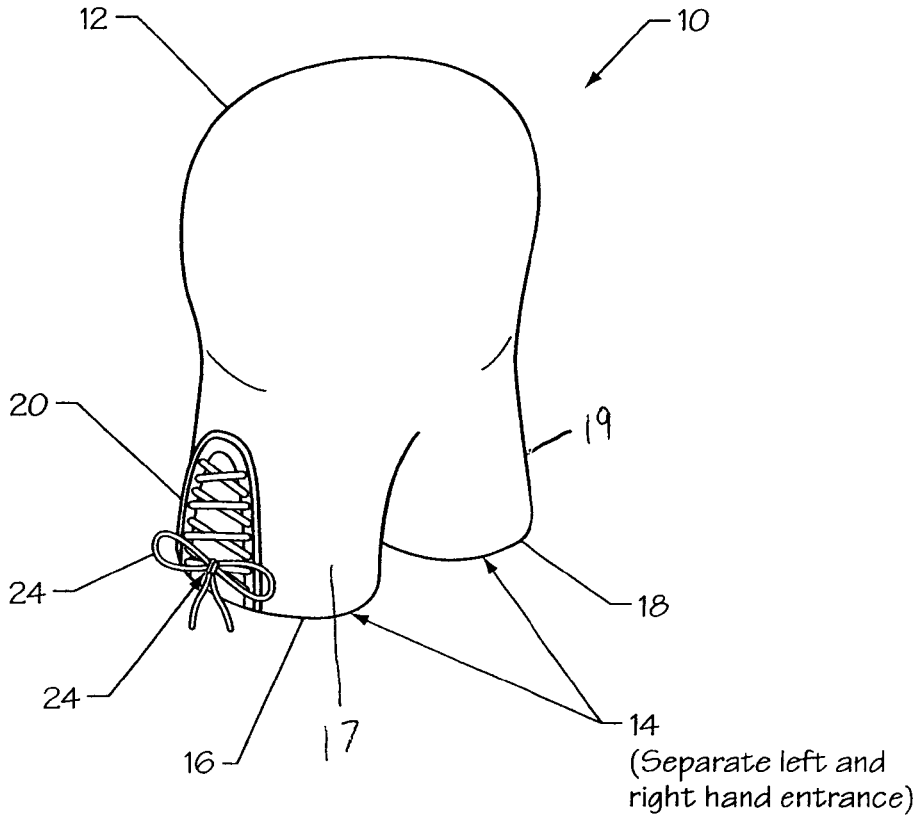
FIG. 1 is a perspective view illustrating a uni boxing glove, constructed in accordance with the present invention.
Figure 2:
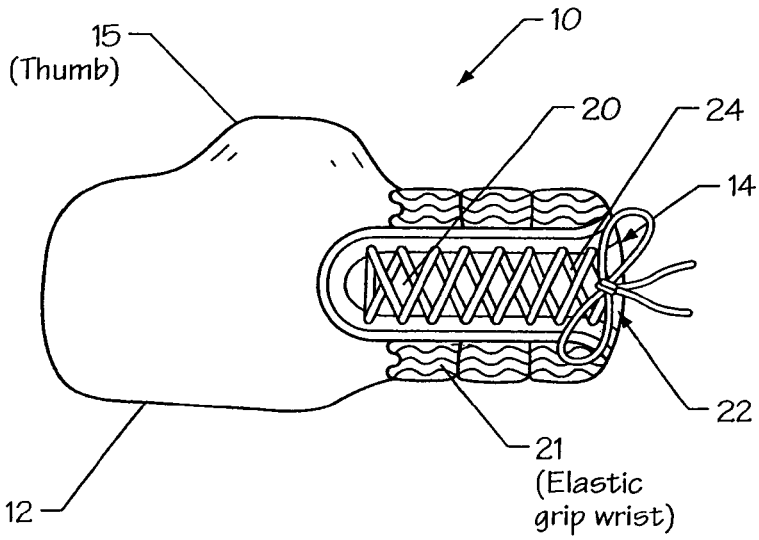
FIG. 2 is an elevational side view illustrating the uni boxing glove, constructed in accordance with the present invention.
Figure 3:
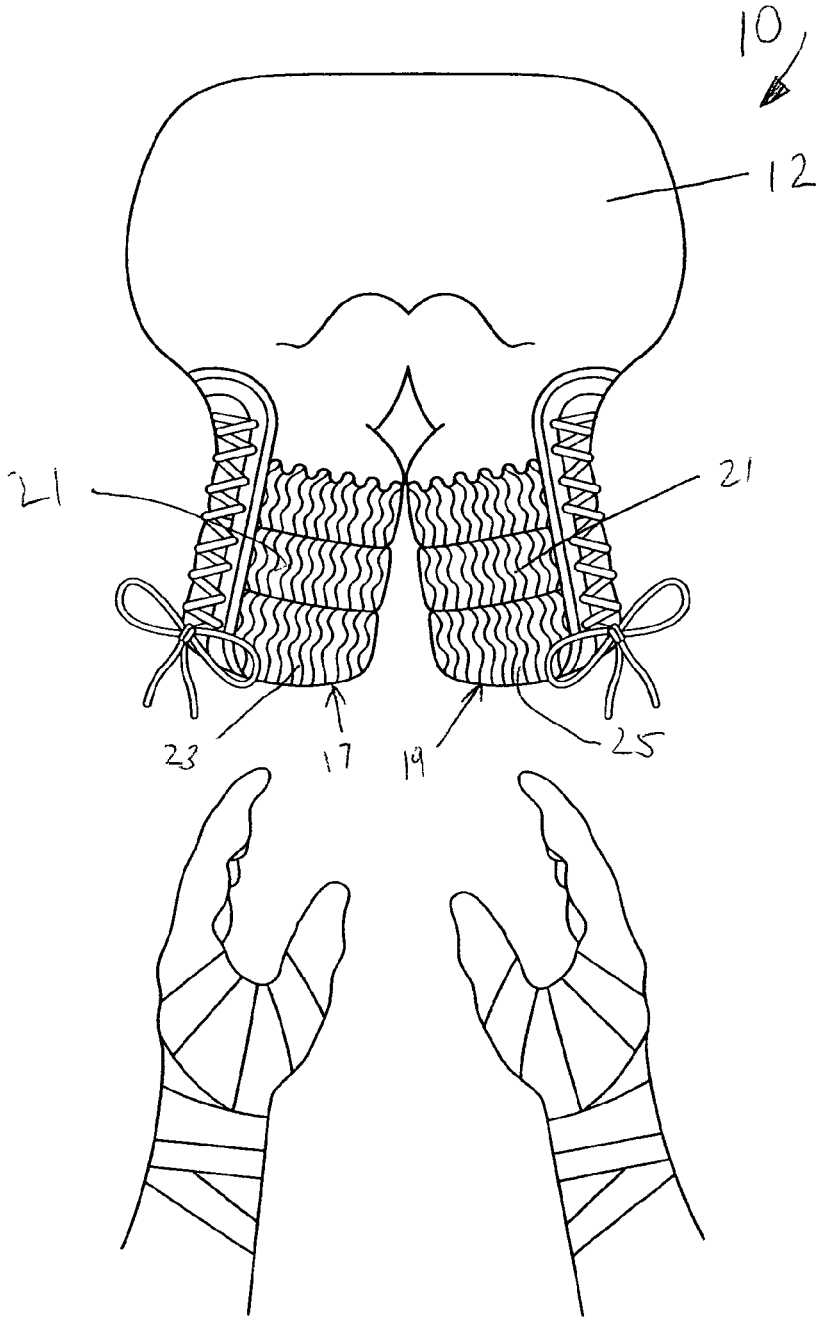
FIG. 3 is a top view illustrating the uni boxing glove, constructed in accordance with the present invention.

As illustrated in FIGS. 1-3, the present invention is a uni boxing glove, indicated generally at 10, for use by professionals and amateurs. The uni boxing glove 10 of the present invention provides a clever enhancement to the popular sport of boxing. The uni boxing glove is a specially designed pair of boxing gloves joined at the fingertips thereby combining two gloves into one uni boxing glove unit.

The uni boxing glove 10 of the present invention includes a punching end 12 and a hand-receiving end 14. The punching end 12 is manufactured from a padded leather material similar to standard regulation boxing gloves. The padded leather material of the punching end 12 confines the fingers and thumb of each hand within the padded leather material. As illustrated in FIGS. 2 and 3, at least one thumb receiving protrusion 15 is formed in the padded leather material to accommodate the thumb of each hand when inserted into the uni boxing glove 10. The protrusion is formed in the punching end 12 for receiving the thumbs only of each hand with the protrusion 15 formed in the padded material opposite the underside and the protrusion 15 protruding above the remaining portions of the punching portion prior to insertion of the hands into punching portion. The protrusion 15 allows a person to don the uni boxing glove 12 in a comfortable manner and to maintain the thumbs away from any of the punching areas of the uni boxing glove 10.

In addition, the uni boxing glove 10 of the present invention includes a first wrist receiving portion 17 secured to the punching end 12 for receiving the wrist of the left hand. A second wrist receiving portion 19 secured to the punching portion for receiving the wrist of the right hand. A left hand opening 16 and a right hand opening 18 are formed at the hand-receiving end 14 of the uni boxing glove 10. The left hand opening 16 and the right hand opening 18 are nearingly adjacent each other. The left hand opening 16 is sized and shaped for receiving the left hand of a user. The right hand opening 18 is sized and shaped for receiving the right hand of a user. Once inserted, the users hands rest within the punching end 12 and the first and second wrist receiving portions 17, 19 cover the left wrist and the right wrist, respectively of the user.

The uni boxing glove 10 of the present invention further includes a slit 20 formed in both the first wrist receiving portion 17 and the second wrist receiving portion 19. Each slit 20 extends from one of the hand openings to the punching end 12.

Surrounding each slit 20 is elastic material 21 which is stretchable when each hand is inserted and holds the first wrist receiving portion 17 and the second wrist receiving portion 19 against the wrists. A first elastic band 23 completely encircles the first wrist receiving portion 17 and extends from the left hand opening 16 to the punching end 12. A second elastic band 25 completely encircles the second wrist receiving portion 19 and extends from the right hand opening 18 to the punching end 12. The elastic material 21 maintains the uni boxing glove 10 about the hands and wrists of the user.

Each slit 20 includes tightening means 22 adjacent both the left hand opening 16 and the right hand opening 18. In a preferred embodiment, the tightening means 22 are a drawstring 24 threaded through the slit 20. As the drawstring 24 is tightened, the slit 20 is pulled closed about the wrist of the user and tied to evenly tighten the left wrist receiving portion 17 about the left wrist of the user and to evenly tighten the right wrist receiving portion 19 about the right wrist of the user. The drawstring 24 can also be used to loosen the wrist receiving portions from about the wrists of the user.

The uni boxing glove 10 of the present invention preferably weighs from approximately eight (8 oz.) ounces for amateur bouts to approximately six (6 oz.) ounces for professional title bouts. Furthermore, the uni boxing glove 10 can be manufactured in a vast array of colors.

The manner of use of the uni boxing glove 10 of the present invention will now be described. It will be understood by those skilled in the art that the manner of use of the uni boxing glove 10 described herein is merely one method of use and other methods of use of the uni boxing glove 10 are within the scope of the present invention.

Figure 4:
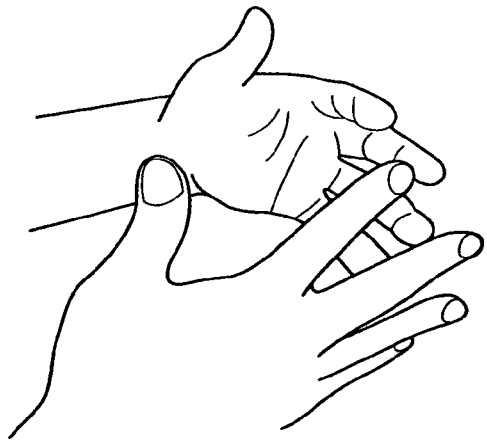
FIGS. 4-6 illustrate the clasping of hands subsequent to insertion into the uni boxing glove.
Figure 5:
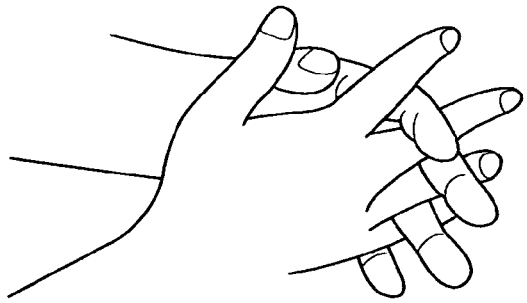
Figure 6:
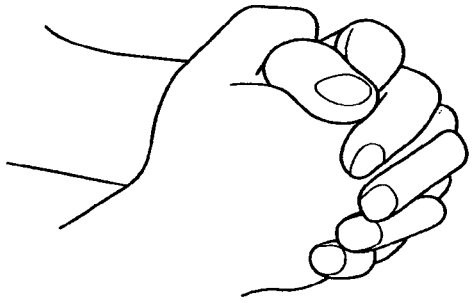

First, as done before regular boxing matches, the user wraps his or her hands in protective tape. Inserting the hands into the corresponding left hand opening 16 and right hand opening 18. As illustrated in FIGS. 4-6, the user clasps his or her hands together. The user then has someone assist them in securing the uni boxing device 10 to each wrist via the attachment means 22. While boxing, the hands are kept together via the clasping of the hands together and the combined uni boxing glove 10. The user is able to stab forward, raise the uni boxing glove 10 to cover, and strike in a side to side manner, making sure that all blows are kept above the belt. The uni boxing glove 10 is employed in the same manner when practicing with a punching bag.

As stated above, the uni boxing glove 10 of the present invention is a clever enhancement to the popular sport of boxing. Combining regulation gloves and effectively "joining them together" at the fingertips, the uni boxing device 10 adds a challenge to boxing, strengthening the skills of both novice and professional boxers, stimulating strategic planning, and enhancing hand/eye coordination. Limiting the range of striking power, the uni boxing glove 10 provides a safer alternative to standard boxing gloves. Usable in standard boxing matches and adhering to all boxing rules and regulations, the uni boxing glove 10 will be appreciated by boxing coaches and athletic instructors the world over. The uni boxing glove 10 could even conceivably revolutionize the sport of boxing.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. More-over, the invention as disclosed herein, may be suitably practiced in the absence of the specific elements which are disclosed herein.

What is claimed is:

1. A uni boxing glove for use in boxing practice and matches, the uni boxing glove covering the left and right hands, fingers, thumb, and a portion of both wrists of a user, the uni boxing glove comprising:

a punching portion formed from a padded material and confining the fingers of each hand, the punching end having padding on at least a front end for forward stabs, on an underside for covering, and on the sides for side to side striking;

a protrusion formed in the punching portion for receiving the thumbs only of each hand, the protrusion formed in the padded material opposite the underside, the protrusion protruding above the remaining portions of the punching portion prior to insertion of the hands into punching portion;

a first wrist receiving portion secured to the punching portion for receiving the wrist of the left hand;

a second wrist receiving portion secured to the punching portion for receiving the wrist of the right hand;

a left hand opening formed in the first wrist receiving portion for receiving the left hand of the user;

a right hand opening formed in the second wrist receiving portion for receiving the right hand of the user, the right hand opening separate from and connected adjacent to the left hand opening;

a first elastic band completely encircling the first wrist receiving portion and extending from the left hand opening to the punching portion;

a second elastic band completely encircling the second wrist receiving portion and extending from the right hand opening to the punching portion;

a first slit formed in the first wrist receiving portion, the first slit extending from the left hand opening to the punching portion;

a second slit formed in the second wrist receiving portion, the second slit extending from the right hand opening to the punching portion;

first tightening means along the first slit extending from left hand opening to the punching portion for evenly tightening the first wrist portion about the wrist and evenly loosening the left hand opening about the wrist; and second tightening means along the second slit extending from the right hand opening to the punching portion for evenly tightening the second wrist portion about the wrist and evenly loosening the second wrist portion about the wrist.

2. The uni boxing glove of claim 1 wherein the punching portion is constructed from a padded leather material.

3. The uni boxing glove of claim 2 wherein the padded leather material confines the fingers and thumb of each hand.

4. The uni boxing glove of claim 1 wherein the tightening means are a drawstring threaded through the slit.

5. The uni boxing glove of claim 4 wherein as the drawstring is tightened, the first and second slits are pulled closed about the wrists of the user and tied to tighten the uni boxing glove about each wrist of the user.

6. The uni boxing glove of claim 1 wherein the uni boxing glove weighs from approximately eight (8 oz.) ounces for amateur bouts to approximately six (6 oz.) ounces for professional title bouts.

7. The uni boxing glove of claim 1 wherein the uni boxing glove is constructed in a vast array of colors.

8. A method for boxing with a glove, the glove covering the left and right hands, fingers, thumb, and a portion of both wrists of a user, the method comprising:

forming a punching portion from a padded material;

forming a protrusion in the punching portion;

protruding the protrusion above the remaining portions of the punching portion prior to insertion of the hands into punching portion;

securing a first wrist receiving portion to the punching portion;

securing a second wrist receiving secured to the punching portion;

forming a left hand opening in the first wrist receiving portion;

forming a right hand opening in the second wrist receiving opening;

completely encircling the first wrist receiving portion with a first elastic band;

extending the first elastic band from the left hand opening to the punching portion;

completely encircling the second wrist receiving portion with a second elastic band;

extending the second elastic band from the right hand opening to the punching portion;

forming a first slit in the first wrist receiving portion;

extending the first slit from the left hand opening to the punching portion;

forming a second slit in the second wrist receiving portion;

extending the second slit from the right hand opening to the punching portion;

inserting the left hand into the left hand opening;

inserting the right hand in the right hand opening;

tightening the left hand opening and the right hand opening about the wrist; and clasping the hands together.

9. The method of claim 8 wherein the punching portion is manufactured from a padded leather material.

10. The method of claim 9 and further comprising:

confining the fingers and thumb of each hand.

11. The method of claim 8 and further comprising:

threading a drawstring through the slit;

tightening the drawstring;

pulling the slit closed about the wrist of the user; and tightening the first and second wrist receiving openings about the wrists of the user.

12. A uni boxing glove for use in boxing practice and matches, the uni boxing glove covering the left and right hands, fingers, thumb, and a portion of both wrists of a user, the uni boxing glove comprising:

a punching portion formed from a padded material and confining the fingers of each hand, the punching end having padding on at least a front end for forward stabs, on an underside for covering, and on the sides for side to side striking;

a protrusion formed in the punching portion for receiving the thumbs only of each hand, the protrusion formed in the padded material opposite the underside, the protrusion protruding above the remaining portions of the punching portion prior to insertion of the hands into punching portion;

a first wrist receiving portion secured to the punching portion for receiving the wrist of the left hand;

a second wrist receiving portion secured to the punching portion for receiving the wrist of the right hand;

a left hand opening formed in the first wrist receiving portion for receiving the left hand of the user;

a right hand opening formed in the second wrist receiving portion for receiving the right hand of the user, the right hand opening separate from and connected adjacent to the left hand opening;

first dual tightening means along a first slit extending from left hand opening to the punching portion for evenly tightening the first wrist portion about the wrist and evenly loosening the left hand opening about the wrist; and second dual tightening means along a second slit extending from the right hand opening to the punching portion for evenly tightening the second wrist portion about the wrist and evenly loosening the second wrist portion about the wrist.

13. The uni boxing glove of claim 12 wherein the punching portion is constructed from a padded leather material.

14. The uni boxing glove of claim 12 wherein the first dual tightening means includes a first elastic band completely encircling the first wrist receiving portion and extending from the left hand opening to the punching portion and the second dual tightening means includes a second elastic band completely encircling the second wrist receiving portion and extending from the right hand opening to the punching portion.

15. The uni boxing glove of claim 14 wherein the tightening means are a drawstring threaded through the slit.

16. The uni boxing glove of claim 15 wherein as the drawstring is tightened, the slit is pulled closed about the wrist of the user and tied to tighten the uni boxing glove about each hand and to the wrist of the user and when the drawstring is loosened, the slit opens about the wrist of the user.

17. The uni boxing glove of claim 12 wherein the uni boxing glove weighs from approximately eight (8 oz.) ounces for amateur bouts to approximately six (6 oz.) ounces for professional title bouts.

18. The uni boxing glove of claim 12 wherein the uni boxing glove is constructed in a vast array of colors.

* * * * *